US006827066B2

(12) United States Patent
Miranda et al.

(10) Patent No.: US 6,827,066 B2
(45) Date of Patent: Dec. 7, 2004

(54) METHOD AND APPARATUS FOR DELIVERING FUEL TO AN ENGINE

(75) Inventors: Victor H. Miranda, Wheaton, IL (US); David V. Rodgers, Bloomingdale, IL (US); James T. Beaucaire, Glen Ellyn, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 105 days.

(21) Appl. No.: 10/301,022

(22) Filed: Nov. 21, 2002

(65) Prior Publication Data

US 2004/0099251 A1 May 27, 2004

(51) Int. Cl.[7] ..... F02M 51/00
(52) U.S. Cl. ..... 123/480

(58) Field of Search ..... 123/480, 179.17; 701/113

(56) References Cited

U.S. PATENT DOCUMENTS 6,571,774 B2 * 6/2003 Yomogida ..... 123/491

* cited by examiner

*Primary Examiner*—Mahmoud Gimie
*Assistant Examiner*—Arnold Castro
(74) *Attorney, Agent, or Firm*—Susan L. Lukasik; Dennis Kelly Sullivan; Jeffrey P. Calfa

(57) ABSTRACT

Immediately following the cranking of an engine, a fuel step is provided (309). The fuel step (305) is an amount of fuel that is less than the cranking fuel amount for an engine, and is provided for a fixed time period (219) once a transition from crank to run in the engine is detected (301). Engine start-up is improved by maintaining engine speed to prevent the engine from stalling, thereby reducing the necessity to restart the engine.

20 Claims, 4 Drawing Sheets

METHOD AND APPARATUS FOR DELIVERING FUEL TO AN ENGINE

FIELD OF THE INVENTION

This invention relates to internal combustion engines, including but not limited to fuel governors for internal combustion engines.

BACKGROUND OF THE INVENTION

Fuel governing functions for internal combustion engines such as diesel engines is known. Fuel governors are utilized to determine how much fuel to provide to the fuel injectors and make ongoing adjustments to the fuel values. Engines typically have three modes: no start (mode 0), cranking (mode 1), and running (mode 2).

During the time when an engine starts to crank, a certain amount of fuel is utilized to turn the engine over, i.e., to cause the engine to reach desired engine speed. Once the engine turns over and begins running in a steady state condition, a lesser amount of fuel is needed than the amount of fuel needed during engine crank.

At various times, the amount of fuel change between cranking and running the engine is substantial. Such a condition is magnified during cold weather or during long sustained cranking due to other engine problems. When such a large change in fuel provided to the engine occurs, a number of undesirable events may occur. A timing diagram illustrating these events according to engine speed, fuel, and engine mode is shown in FIG. 1.

As shown in the left side of FIG. 1, once reaching running mode is achieved, the fuel amount is reduced, causing the engine to stumble or hesitate. Additional fuel is added, but the added fuel is not enough to maintain engine speed. When the engine speed drops too far, the engine stalls, requiring another crank cycle, thereby wasting fuel. As illustrated in the far right side of FIG. 1, the added fuel prompts the engine to overshoot its desired speed, setting off oscillation in both engine speed and fuel supplied, which in turn causes the engine to fluctuate between cranking and running modes, resulting in the engine running in a rough manner until the oscillation ceases.

Accordingly, there is a need for a fuel governor that reduces or eliminates engine stumbling, hesitation, stalling, and other undesirable events when significant changes in fuel provided to an engine occur.

SUMMARY OF THE INVENTION

A method of delivering fuel to an engine includes the steps of detecting an engine mode change from cranking mode to running mode and determining a step fuel amount. In response to the step of detecting, the step fuel amount is delivered to the engine during a step time. When the step time expires, a fuel amount generated by the fuel governor is provided to the engine.

DESCRIPTION OF A PREFERRED EMBODIMENT

The following describes an apparatus for and method of providing a fuel step immediately following the cranking of an engine. The fuel step is an amount of fuel that is less than the cranking fuel amount for an engine, and is provided for a fixed time period once a transition from crank to run in the engine is detected. Engine start-up is improved by maintaining engine speed to prevent the engine from stalling, thereby reducing the necessity to restart the engine.

Figure 2:
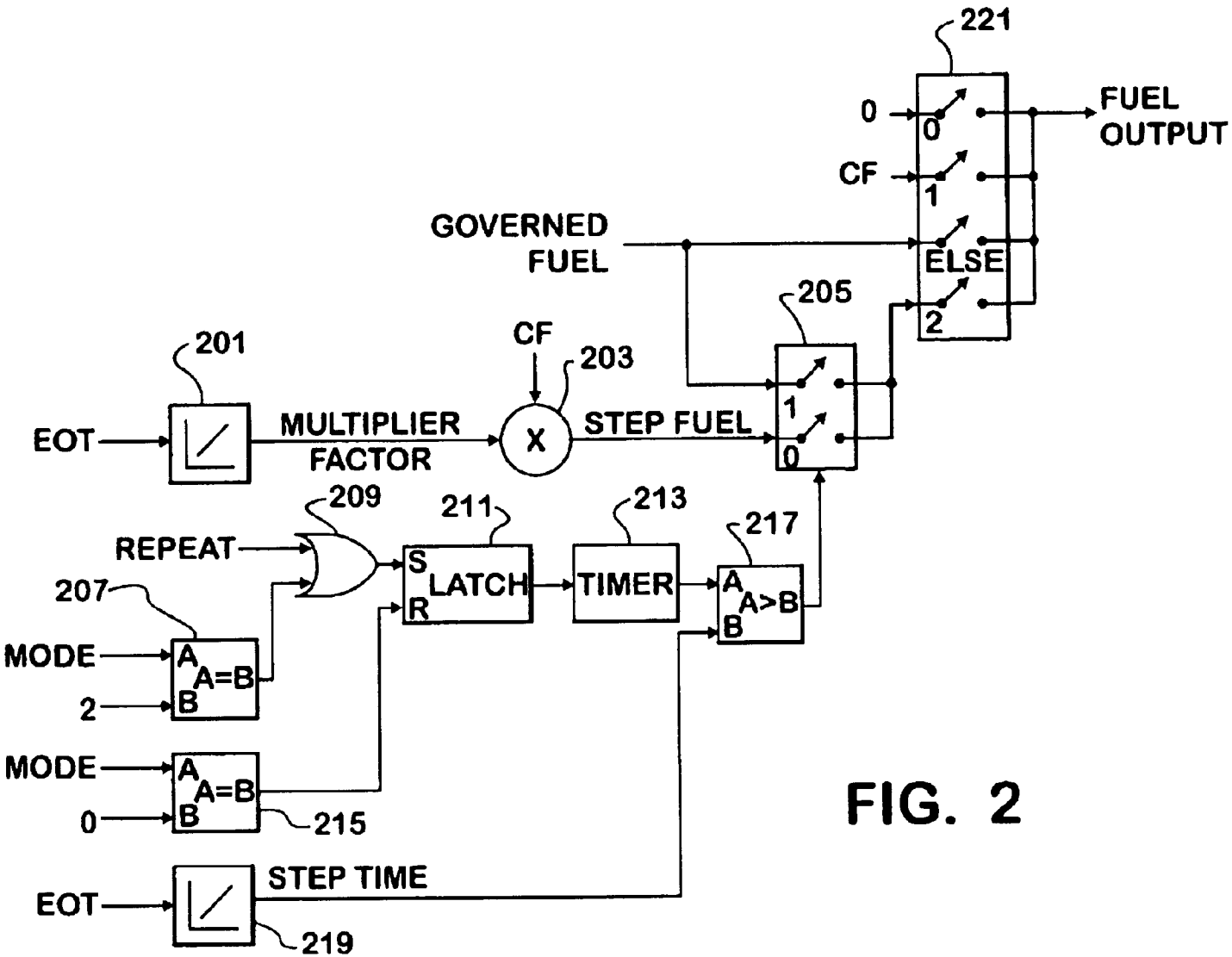
FIG. 2 is a block diagram of a fuel output system in accordance with the invention.

A block diagram of a fuel output system is shown in FIG. 2. A first temperature function block 201 receives engine oil temperature (EOT) as an input and determines a multiplier factor based on EOT. The multiplier factor is based on the viscous characteristics of engine oil at a given temperature and is stored for use by, for example, an Engine Control Module (ECM). A multiplier 203 multiplies the multiplier factor by the amount of fuel utilized during engine cranking (CF), resulting in a step fuel amount that is less than the cranking fuel amount. The step fuel amount may also be less than the running fuel amount. The running fuel amount is typically the steady state fuel amount that is provided to the engine once it reaches running mode after cranking is complete. The multiplier factor may be, for example, 0.4. The step fuel amount is provided as one input to a first switch 205, whose other input is a governed fuel amount. The governed fuel amount is the amount of fuel determined by a fuel governor based on ambient conditions, speed and load driving demands, and current engine conditions. Many types of fuel governors are known in the art.

A first comparator 207 determines whether the current mode of the engine is running, i.e., mode 2. The comparator 207 begins to output a logical high when the engine changes from cranking mode to running mode. This transition to a logical high flows through an OR gate 209 and sets the latch 211, which starts a count-up timer 213. A second comparator 215 determines whether the current mode of the engine is no start, i.e., mode 0. The comparator 215 begins to output a logical high when the engine changes from running mode or cranking mode to no-start mode. This transition to a logical high resets the latch 211 and stops count-up timer 213.

The output of the timer 213 is input to a third comparator 217. A second temperature function block 219 receives engine oil temperature (EOT) as an input and determines a step time based on EOT. The step time is empirically determined to provide desired engine performance. The step time may be, for example, 1 second. The step time is input to the third comparator 217, which outputs a logical low signal while the timer 213 value is less than the step time and outputs a logical high signal otherwise. The output of the third comparator controls the first switch 205. When the third comparator outputs a logical low ("0") signal, the step fuel amount is output by the first switch. When the third comparator outputs a logical high ("1") signal, the governed fuel amount is output by the first switch.

A second switch 221 determines the fuel output that is delivered to the engine. Fuel delivery is provided to the engine in many ways known in the industry, such as by electronically and/or hydraulically controlled fuel injectors. The output of the second switch is determined by the engine mode. When the engine is in no start mode ("0"), the second switch 221 outputs zero fuel. When the engine is in cranking mode ("1"), the second switch 221 outputs the cranking fuel (CF) amount. When the engine is in running mode ("2"), the second switch 221 outputs the output of the first switch 205. In any other conditions, the second switch 221 outputs the governed fuel amount.

In the event it is desired to provide multiple steps of fuel provision once the transition from cranking to running mode is detected, a repeat signal is input to the OR gate 209 to initiate provision of another fuel step. Any number of fuel steps may be strategically selected in order to more gradually reduce fuel levels to the running mode fuel amount. For example, if the running fuel amount is 25% of the cranking fuel amount, the first step fuel amount following the cranking fuel may be 40% to 45% of the cranking fuel amount, and a second step fuel amount that follows the first step fuel amount may be 30 to 35% of the cranking fuel amount. Alternatively, for successive fuel steps, the first step may be down from the cranking amount, and the second step may provide an increase in fuel amount from the first step. The step time values may be the same, or may be different, depending on desired engine performance. For example, a first step time may be 1 second and a second step time may be ½ second. Multiplier factors and step times from previous steps may be stored at the temperature function blocks 201 and 219 for use in determining successive multiplier factors and step times, respectively.

Figure 3:
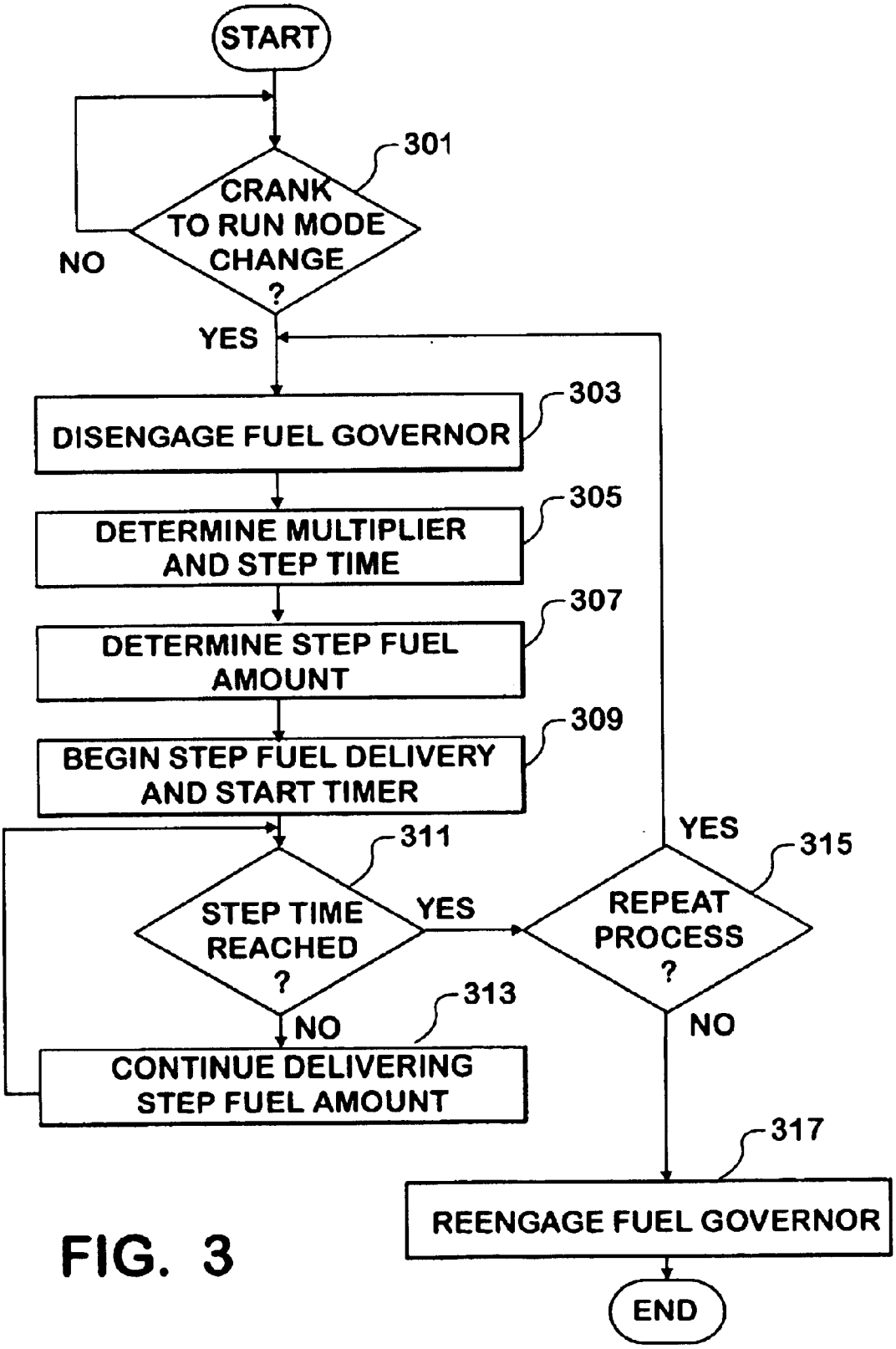
FIG. 3 is a flowchart illustrating a method of step fuel application in accordance with the invention.

A flowchart illustrating a method of step fuel application is shown in FIG. 3. When a mode change is detected from cranking mode (1) to running mode (2) at step 301, the fuel governor is temporarily disengaged as the fuel output source at step 303. The fuel governor may be considered to be disengaged in any number of ways, including ignoring output from the fuel governor, switching in a different output than that of the fuel governor, turning off fuel governor calculations, and/or other ways of overriding or preempting the fuel governor's output from determining the amount of fuel delivered or provided to the engine.

At step 305, a multiplier factor and a step time are determined. At step 307, a step fuel amount is determined. One method of obtaining the step fuel amount is to multiply the cranking fuel by a multiplier factor that is less than one, such that the step fuel amount is less than the cranking fuel amount. Another method of obtaining the step fuel amount is to multiply the running fuel by a multiplier factor that is greater than or less than one, such that the desired step fuel amount is obtained. The step fuel amount may be determined in other ways.

At step 309, the fuel step amount is provided to the engine and a timer, set to the step time value determined at step 305, starts to run. Until the timer reaches the step time value at step 311, the step fuel amount continues to be delivered to the engine at step 313, and the process continues with step 311. Once the timer reaches the step time value at step 311, the process continues with step 315. If it is desired to repeat the step-down process of fuel delivery at step 315, the process continues with step 303. If it is not desired to repeat the step-down process of fuel delivery at step 315, the process continues with step 317, where the fuel governor is reengaged, and the process ends.

The fuel output system of FIG. 2 and flowchart of FIG. 3 are implemented in an engine control module (ECM) as software. The ECM may be a conventional engine control module that is readily available in the industry.

Figure 1:
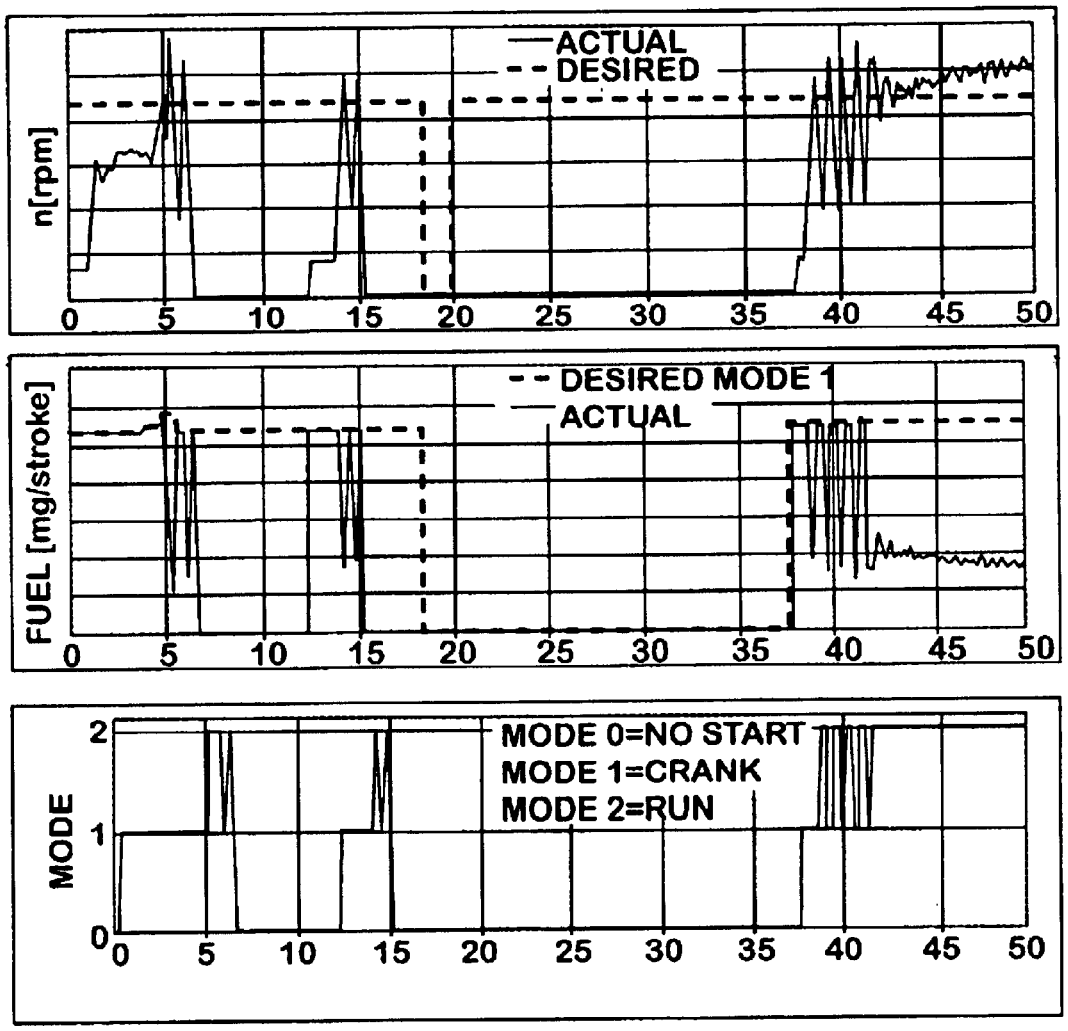
FIG. 1 is a timing diagram illustrating engine speed, fuel, and engine mode.
Figure 4:
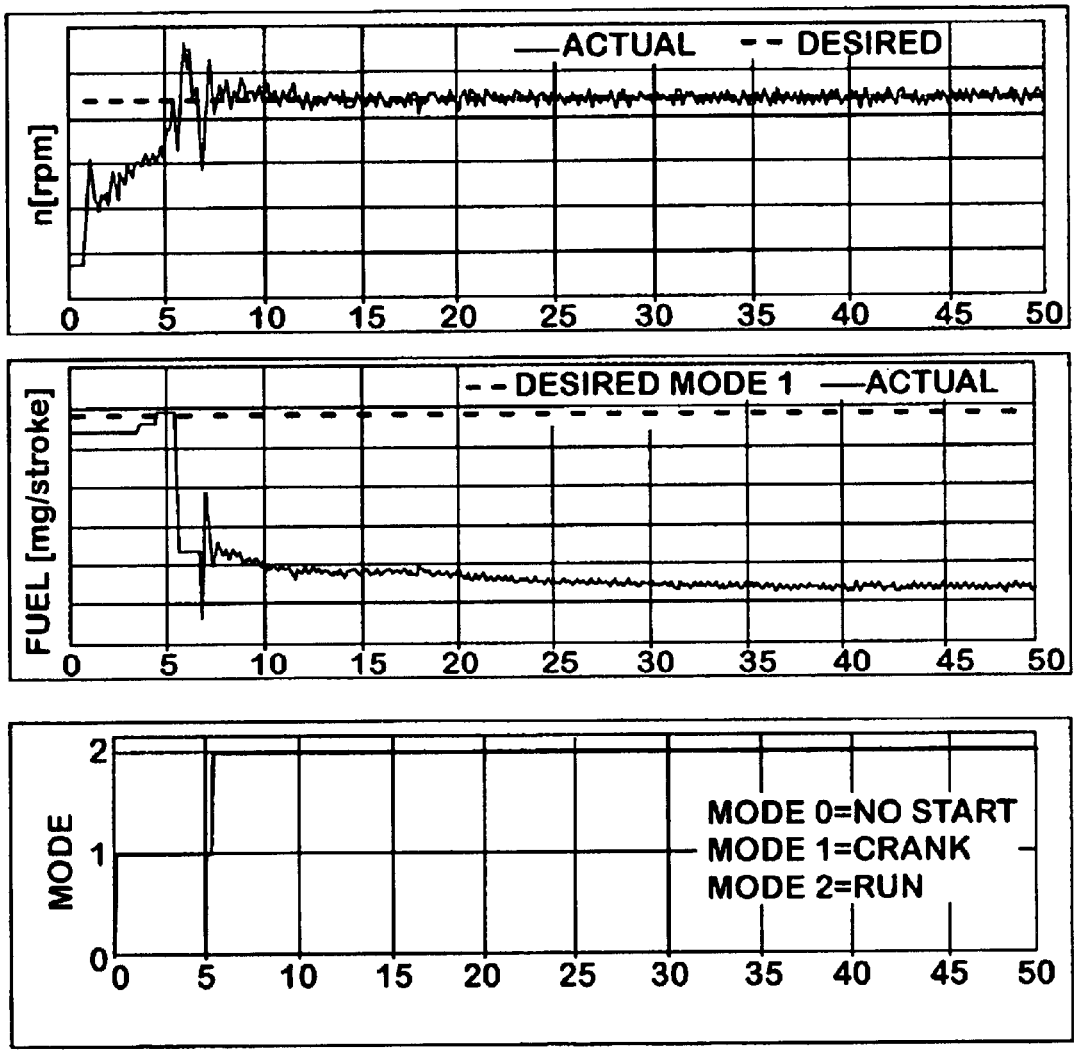
FIG. 4 is a timing diagram illustrating engine speed, fuel, and engine mode in accordance with the invention.

A timing diagram illustrating engine speed, fuel, and engine mode is shown in FIG. 4. As shown near the left side of the timing diagram, as the engine mode changes from crank (1) to run (2) in the lower third of the diagram, a step fuel amount that is less than the cranking fuel amount is provided to the engine for a fixed period of time, as shown in the middle third of the diagram. During the transition from crank to run, engine oscillation, as shown in the top third of the diagram, is greatly reduced, as compared to that shown in FIG. 1, and the engine starts without stalling and with little oscillation.

The present invention improves engine start-up by reducing the necessity to restart the engine. By reducing the need to crank the engine repeatedly to start the engine, fuel consumption is reduced and the associated emissions, such as hydrocarbons, are significantly reduced. Diminished engine noise on start-up results. Consistent engine staring and reliability are achieved, especially in cold weather conditions.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A method comprising the steps of:

detecting an engine mode change from cranking mode to running mode;

determining a step fuel amount;

in response to the step of detecting, delivering the step fuel amount to the engine during a step time;

when the step time expires, providing, to the engine, a fuel amount generated by the fuel governor.

2. The method of claim 1, further comprising the step of determining a multiplier factor by which a cranking fuel amount is multiplied to yield the step fuel amount, such that the step fuel amount is less than the cranking fuel amount.

3. The method of claim 1, further comprising the step of determining a multiplier based on oil temperature in the engine.

4. The method of claim 1, further comprising the step of determining the step time based on oil temperature in the engine.

5. The method of claim 1, further comprising the step of, when the step time expires, repeating the determining and delivering steps for a second step time and a second step fuel amount prior to the providing step.

6. The method of claim 1, wherein the step of determining a step fuel amount comprises the step of determining the step fuel amount independent of fuel amount requested by an accelerator for the engine.

7. The method of claim 1, wherein the step time is at least partially determined to prevent the engine from stalling.

8. The method of claim 1, wherein the step fuel amount maintains engine speed to prevent the engine from stalling.

9. An apparatus comprising:

a mode change detector;

a step timer operatively connected to the mode change detector;

a fuel determiner, arranged and constructed to determine a step fuel amount;

a switch operatively connected to the step timer and the fuel determiner, such that the switch outputs the step fuel amount for an engine while the step timer is operating and outputs a fuel amount for the engine from a fuel governor when the step timer is not operating.

10. The apparatus of claim 9, wherein the fuel determiner comprises a multiplier and a temperature function that determines a multiplier factor based on a temperature in the engine.

11. The apparatus of claim 9, further comprising a temperature function that determines a step time during which the timer operates, wherein the step time is based on a temperature in the engine.

12. The apparatus of claim 9, wherein the fuel determiner is arranged and constructed to determine a step fuel amount independent of fuel amount requested by an accelerator for the engine.

13. The apparatus of claim 9, wherein the step timer is set to run for a time period at least partially determined to prevent the engine from stalling.

14. The apparatus of claim 9, wherein the step fuel amount maintains engine speed to prevent the engine from stalling.

15. A method comprising the steps of:

detecting an engine mode change from cranking mode to running mode;

in response to the detecting step, temporarily disengaging a fuel governor;

determining a first step fuel amount and delivering the step fuel amount to the engine during a first step time in response to the step of detecting;

when the first step time expires, determining a second step fuel amount and delivering the second step fuel amount to the engine during a second step time that begins when the first step time expires;

when the second step time expires, reengaging the fuel governor.

16. The method of claim 15, further comprising the step of determining a first multiplier factor by which a cranking fuel amount is multiplied to yield the first step fuel amount, such that the first step fuel amount is less than the cranking fuel amount.

17. The method of claim 16, further comprising the step of determining a second multiplier factor by which a cranking fuel amount is multiplied to yield the second step fuel amount, such that the second step fuel amount is between the first step fuel amount and a running fuel amount.

18. The method of claim 16, wherein the first multiplier is based on oil temperature in the engine.

19. The method of claim 17, wherein the second multiplier is based on oil temperature in the engine.

20. The method of claim 15, further comprising the step of determining the first step time and the second step time based on oil temperature in the engine.

* * * * *